US012435947B2

(12) United States Patent
Batista Ammerman

(10) Patent No.: US 12,435,947 B2
(45) Date of Patent: Oct. 7, 2025

(54) PROJECTILE LAUNCHING DEVICE

(71) Applicant: Joao Marcos Batista Ammerman, Arvada, CO (US)

(72) Inventor: Joao Marcos Batista Ammerman, Arvada, CO (US)

( * ) Notice: Subject to any disclaimer, the term of this patent is extended or adjusted under 35 U.S.C. 154(b) by 417 days.

(21) Appl. No.: 18/088,146

(22) Filed: Dec. 23, 2022

(65) Prior Publication Data

US 2024/0210141 A1 Jun. 27, 2024

(51) Int. Cl.
*F41B 7/00* (2006.01)

(52) U.S. Cl.
CPC ..... *F41B 7/003* (2013.01)

(58) Field of Classification Search
CPC ..... F41B 5/0094; F41B 5/12; F41B 5/123; F41B 5/14; F41B 5/1469; F41B 7/00; F41B 7/003
USPC ..... 124/20.3, 25, 26, 27
See application file for complete search history.

(56) References Cited

U.S. PATENT DOCUMENTS 3,028,851 A * 4/1962 Drake ..... F41B 5/12 124/16
3,509,863 A * 5/1970 Barker ..... F41B 7/003 124/31
3,515,113 A * 6/1970 Lawrence ..... F41B 5/12 124/25
3,874,359 A * 4/1975 Cesin ..... F41B 5/12 124/16
4,169,456 A * 10/1979 Van House ..... F41B 5/12 124/25
4,388,914 A * 6/1983 Cesin ..... F41B 5/12 124/40
4,603,676 A * 8/1986 Luoma ..... F41B 5/123 124/40
4,688,539 A * 8/1987 Lawrence ..... F41B 5/12 124/84
4,719,897 A * 1/1988 Gaudreau ..... F41B 5/14 124/35.1
5,224,464 A 7/1993 Burnham
5,445,139 A * 8/1995 Bybee ..... F41B 5/14 124/25
5,553,598 A 9/1996 Johnson
5,749,348 A * 5/1998 Oviedo-Reyes ..... F41B 5/12 124/25
6,273,078 B1 * 8/2001 Schwesinger ..... F41B 7/003 124/16

(Continued)

FOREIGN PATENT DOCUMENTS

WO WO2020088936 5/2020

*Primary Examiner* — Alexander R Niconovich

(57) ABSTRACT

A projectile launching device for hunting and target shooting includes a barrel and a driver. A carriage is slidably engaged to a guide rail, with a lower end of the carriage extending through a slot positioned in a bottom of the barrel and extending along the guide rail. The driver is attached to the carriage and extends along the bottom of the barrel toward an open end of the barrel. A pair of first arms is pivotally attached to the barrel proximate to a butt end of the barrel. Each first arm is operationally engaged to the driver distal from the carriage and can be pivoted by user to pivot to charge the driver, which is locked by a catch. A switch attached to the barrel can be switched to discharge the driver to propel a projectile from the barrel.

11 Claims, 4 Drawing Sheets

(56) References Cited

U.S. PATENT DOCUMENTS 6,799,566 B1 * 10/2004 Malucelli ..... F41B 5/12 124/25
7,017,568 B1 * 3/2006 Smith ..... F41B 5/1469 124/25
7,954,413 B2 6/2011 Koth
8,312,869 B2 * 11/2012 Gillet ..... A01K 81/06 124/20.3
8,485,170 B1 * 7/2013 Prior ..... F41B 5/123 124/25
8,485,171 B2 7/2013 Romney
8,567,376 B2 * 10/2013 Flint ..... F41B 5/12 124/20.3
8,607,773 B1 * 12/2013 Schultz ..... F41B 5/123 124/56
8,789,520 B2 * 7/2014 Nebergall ..... F41B 5/10 124/25.6
8,863,732 B1 * 10/2014 Prior ..... F41B 5/123 124/25
9,255,764 B2 * 2/2016 Park ..... F41B 7/003
9,389,041 B2 * 7/2016 Novikov ..... F41B 5/00
9,518,796 B2 * 12/2016 Carroll, Jr. ..... F41B 5/12
9,518,797 B2 * 12/2016 Carroll, Jr. ..... F41B 5/12
9,714,808 B2 * 7/2017 Carroll, Jr. ..... F41B 5/12
9,719,749 B1 * 8/2017 Prior ..... F41B 3/005
9,851,173 B2 * 12/2017 Malheiros ..... F41B 11/62
10,359,254 B1 * 7/2019 Kempf ..... F41B 5/12
10,533,823 B1 * 1/2020 Smith ..... F41B 7/04
D928,901 S 8/2021 Ren
11,181,336 B2 * 11/2021 Thalberg ..... F41B 5/123
11,512,921 B1 * 11/2022 Xiao ..... F41B 5/0094
11,525,650 B1 * 12/2022 Nebergall ..... F41B 5/0094
11,698,240 B2 * 7/2023 Thalberg ..... F41B 5/123 124/25
11,713,941 B1 * 8/2023 Crist ..... F41B 5/12 124/25
11,874,085 B2 * 1/2024 Barnett ..... F41B 5/123
2009/0223500 A1 * 9/2009 Stanziale ..... F41B 5/123 124/25
2010/0037878 A1 * 2/2010 Leinbach ..... F41B 7/00 124/16
2012/0210990 A1 * 8/2012 Park ..... F41B 5/0094 124/17
2013/0312724 A1 * 11/2013 Hudkins ..... F41B 5/123 124/25
2015/0354916 A1 * 12/2015 Polanich ..... F41B 7/003 124/25.6
2021/0381571 A1 12/2021 Hansen
2023/0184507 A1 * 6/2023 Ash ..... F41B 11/62 124/56

* cited by examiner

PROJECTILE LAUNCHING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to launching devices and more particularly pertains to a new launching device for hunting and target shooting. The present invention discloses a launching device that uses network of arms to compress a spring, which then drives a carriage to launch a projectile from a barrel.

(2) Description of Related Art Including Information Disclosed Under 37 CFR 1.97 and 1.98

The prior art relates to launching devices, which may comprise bows that prime a piston when drawn and cross-bow cocking mechanisms. What is lacking in the prior art is a launching device comprising a spring driven carriage that launches a projectile from a barrel.

BRIEF SUMMARY OF THE INVENTION

An embodiment of the disclosure meets the needs presented above by generally comprising a barrel and a driver. A guide rail is attached to the barrel and extends along a slot, which is positioned in a bottom of the barrel. A carriage is slidably engaged to the guide rail, with a lower end of the carriage extending through the slot. The barrel is configured for insertion of a projectile so that the projectile is positioned adjacent to the carriage. The driver is attached to the carriage and extends along the bottom of the barrel toward an open end of the barrel. A pair of first arms is pivotally attached to and extends bilaterally from the barrel proximate to a butt end of the barrel. Each first arm is operationally engaged to the driver distal from the carriage and is configured to be grasped in a respective hand of a user, positioning the user to pivot the first arms relative to the barrel to charge the driver. A catch is attached to the barrel and is configured to selectively attach to the driver upon charging of the driver. A switch, which is attached to the barrel and which is operationally engaged to the catch, is configured to be switched to discharge the driver to propel the projectile from the barrel.

Another embodiment of the disclosure includes a projectile launching system comprising a projectile launching device, as disclosed above, which has a projectile, such as an arrow, inserted into a barrel of the system.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
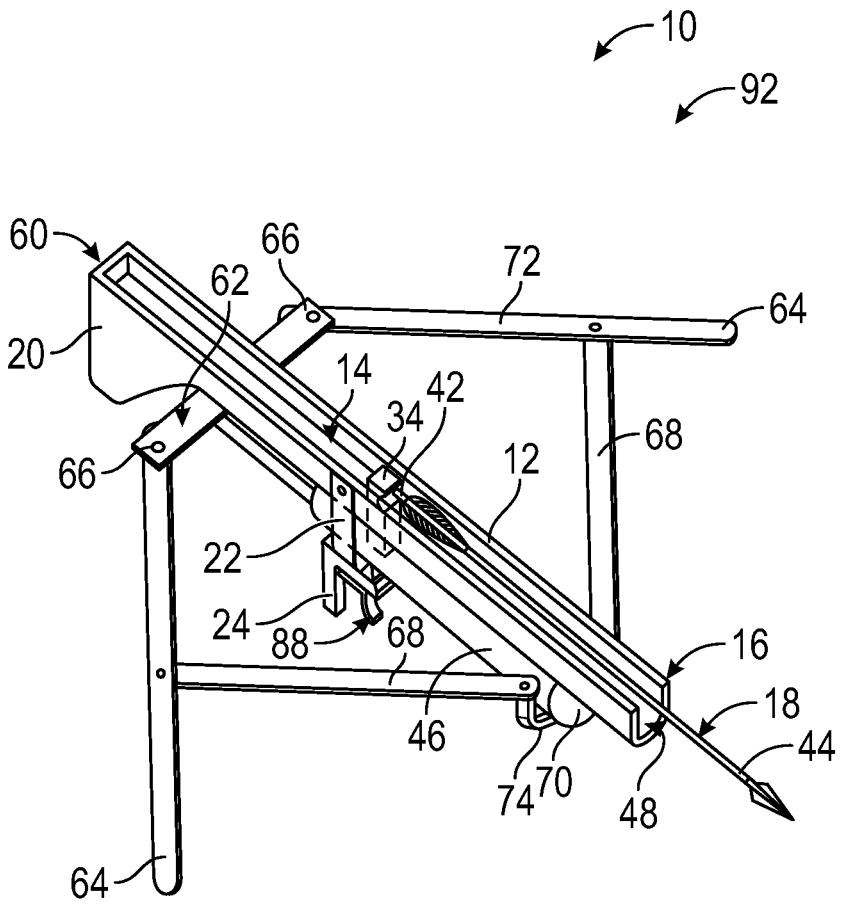
FIG. 1 is an isometric perspective view of a projectile launching device according to an embodiment of the disclosure.
Figure 2:
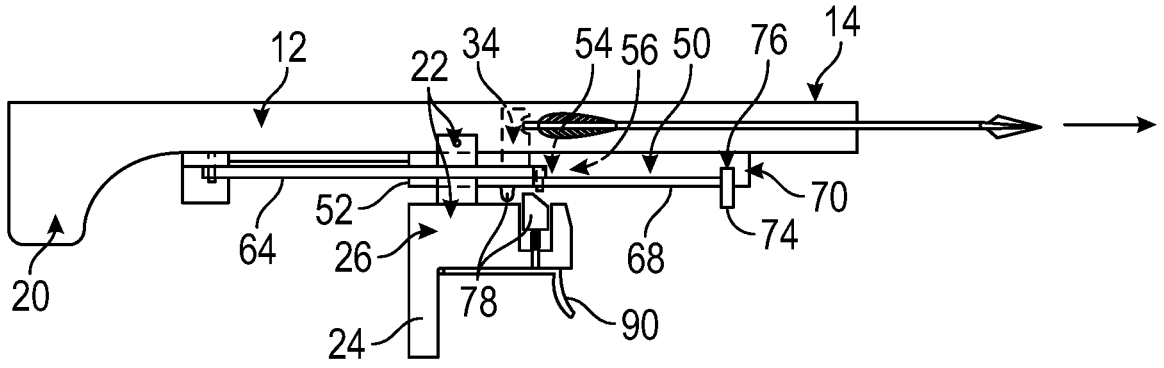
FIG. 2 is a side view of an embodiment of the disclosure.
Figure 3:
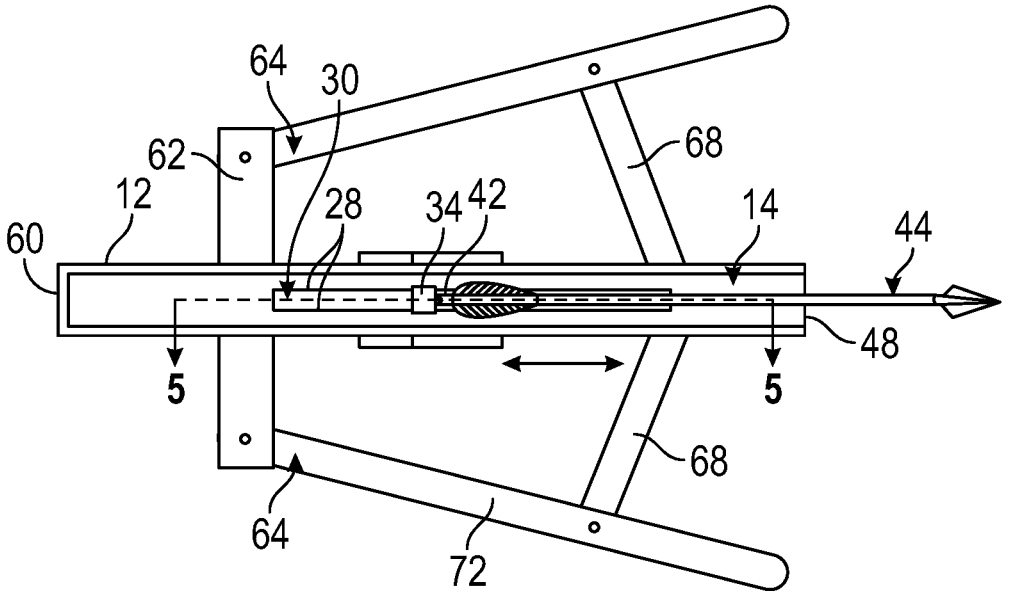
FIG. 3 is a top view of an embodiment of the disclosure.
Figure 4:
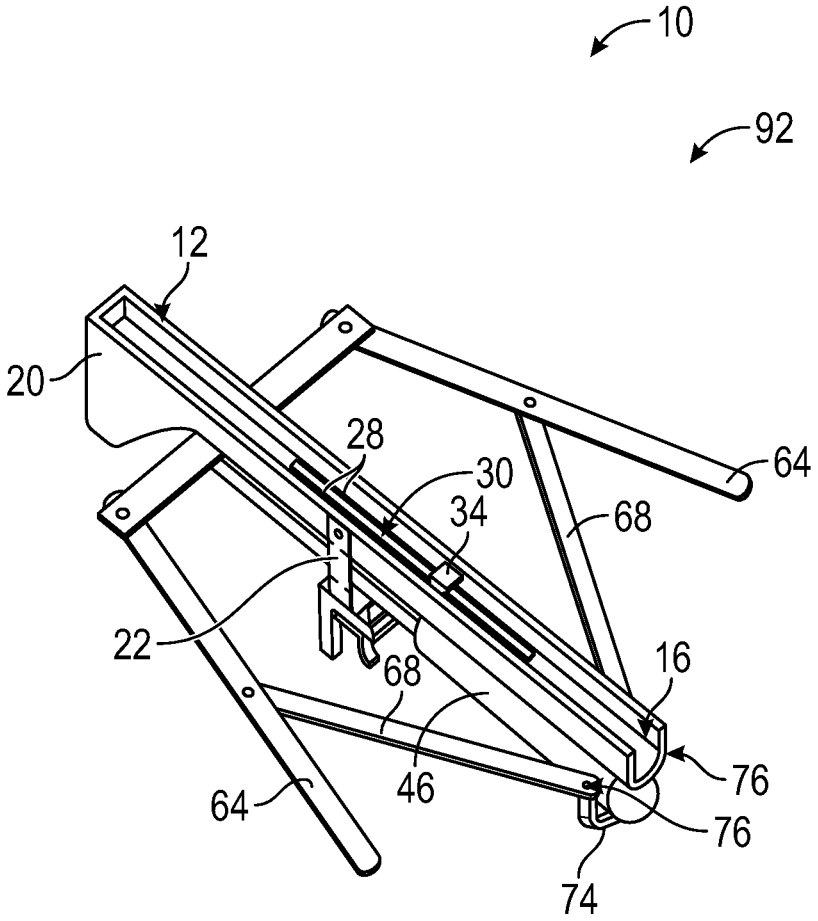
FIG. 4 is an isometric perspective view of an embodiment of the disclosure.

With reference now to the drawings, and in particular to FIGS. 1 through 5 thereof, a new launching device embodying the principles and concepts of an embodiment of the disclosure and generally designated by the reference numeral 10 will be described.

As best illustrated in FIGS. 1 through 5, the projectile launching device 10 generally comprises a barrel 12, which has a top 14 that is open so that a cross-sectional profile 16 of the barrel 12 is U shaped. The present invention also anticipates the top 14 of the barrel 12 being closed and the barrel 12 having a cross-sectional profile 16 that is circular. However, as will become apparent, the top 14 of the barrel 12 being open facilitates loading of a projectile 18 that is elongated. A stock 20 is attached to the barrel 12 is configured to abut a respective shoulder of a user. A bracket 22 is attached to and extends from the barrel 12. A handle 24, which is attached to and which extends from a lower piece 26 of the bracket 22, is configured to be grasped a respective hand of the user to wield the projectile launching device 10.

A guide rail 28 is attached to the barrel 12 and extends along a slot 30, which is positioned in a bottom 32 of the barrel 12. The guide rail 28 may comprise a pair of guide rails 28, the guide rails 28 of which bracket the slot 30. A carriage 34 is slidably engaged to the guide rail 28, with a lower end 36 of the carriage 34 extending through the slot 30. The barrel 12 is configured for insertion of a projectile 18 so that the projectile 18 is positioned adjacent to the carriage 34. A notch 38 may be positioned in a forward facet 40 of the carriage 34 so that it can engage a nock 42 of an arrow 44 or a bolt. The present invention also anticipates the carriage 34 having a variety of shapes to complement projectiles 18 of a variety of configurations. For example, the forward facet 40 of the carriage 34 may be concavely arcuate to accommodate a projectile 18 that is ball shaped or a that has a convexly arcuate portion.

A driver 46 is attached to the carriage 34 and extends along the bottom 32 of the barrel 12 toward an open end 48 of the barrel 12. The driver 46 may comprise a cylinder 50, which is attached, proximate to its first terminus 52, to the lower end 36 of the carriage 34. The cylinder 50 is slidably attached to the bottom 32 of the barrel 12. A channel 54 extends into the first terminus 52 of the cylinder 50. A spring 56 is positioned in the channel 54. A rod 58 is attached to the barrel 12 and extends between the bottom 32 of the barrel 12 and the lower piece 26 of the bracket 22. The rod 58 is aligned with and is selectively insertable into the channel 54. The spring 56 is compressed by the rod 58 as the cylinder 50 is motivated along the barrel 12 from the open end 48 toward a butt end 60 of the barrel 12. The present invention anticipates the driver 46 comprising other driving means, such as, but not limited to, pneumatic cylinders or the like.

A crossbar 62 is attached to and extends bilaterally from the barrel 12 proximate to the butt end 60 of the barrel 12. Each first arm 64 of a pair of first arms 64 is pivotally attached to the crossbar 62 proximate to a respective opposed end 66 of the crossbar 62 so that the first arms 64 extend bilaterally from the barrel 12. Each first arm 64 is operationally engaged to the driver 46 distal from the carriage 34 and is configured to be grasped in a respective hand of the user. The user is positioned to pivot the first arms 64 relative to the barrel 12 to charge the driver 46.

The first arms 64 may be attached to the driver 46 by a pair of second arms 68, cables, cords, or the like. Each second arm 68 is pivotally attached to and extends between the cylinder 50, proximate to a second terminus 70 of the cylinder 50, and a respective first arm 64. A shown in FIG. 4, the second arm 68 is attached to the respective first arm 64 proximate to its midpoint 72. A bar 74 may be is attached to the cylinder 50 proximate to a second terminus 70 of the cylinder 50. The bar 74 is flattened U-shaped so that opposing ends 76 of the bar 74 bracket the cylinder 50. Each second arm 68 is pivotally attached to a respective opposing end 76 of the bar 74.

Figure 5:
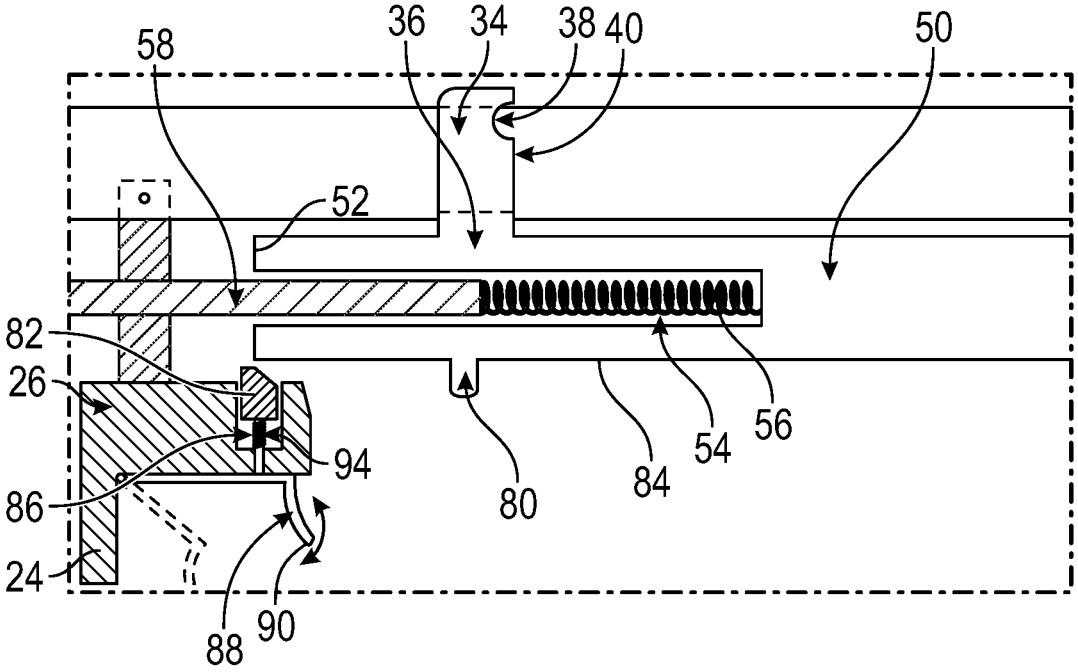
FIG. 5 is a cross-sectional view of an embodiment of the disclosure.

A catch 78 is attached to the barrel 12 and is configured to selectively attach to the driver 46 upon charging of the driver 46. The catch 78 may comprise a first knob 80 and a second knob 82. The first knob 80 is attached to an underside 84 of the cylinder 50 proximate to the first terminus 52. As shown in FIG. 5, a recess 86 extends into the lower piece 26 of the bracket 22. A pin 94, which is spring loaded, is attached to the lower piece 26 and is positioned in the recess 86. The second knob 82 is attached to the pin 94 and is tapered distal from the pin 94. The second knob 82 is depressible into the recess 86 upon contact with the first knob 80 as the cylinder 50 is motivated along the barrel 12 from the open end 48 toward the butt end 60, whereupon the second knob 82 extends from the recess 86 to lock the driver 46 in a cocked configuration. The present invention anticipates the catch 78 comprising other means of locking the driver 46 in the cocked configuration, which are known to those skilled in the art of crossbow cocks, gun cocks, and the like.

A switch 88, which is attached to the barrel 12 and which is operationally engaged to the catch 78, is configured to be switched to discharge the driver 46 to propel the projectile 18 from the barrel 12. The switch 88 may comprise a trigger 90, which is operationally engaged to the second knob 82. The second knob 82 is retracted into the recess 86 upon pulling of the trigger 90 and the spring 56 rebounds to propel the projectile 18 from the barrel 12. The switch 88 may comprise other switching means, such as, but not limited to, push buttons, toggles, or the like.

Another embodiment of the disclosure includes a projectile launching system 92 comprising a projectile launching device 10, as disclosed above, which has a projectile 18, such as an arrow 44, inserted into a barrel 12 of the system 92.

In use, the first arms 64 are grasped in the hands of the user and pulled toward the butt end 60 of the barrel 12. The spring 56 is compressed and the cylinder 50 locked in place by the catch 78. The user then can insert an arrow 44 into the barrel 12 and engage a nock 42 of the arrow 44 with the notch 38 in the carriage 34. Upon taking aim, the trigger 90 is engaged to release the catch 78, causing the spring 56 to rebound. The force from the spring 56 is transferred to the carriage 34, which slides along the guide rail 28 to propel the arrow 44 from the barrel 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A projectile launching device comprising:

a barrel;

a slot positioned in a bottom of the barrel;

a guide rail attached to the barrel and extending along the slot;

a carriage slidably engaged to the guide rail, a lower end of the carriage extending through the slot, wherein the barrel is configured for insertion of a projectile, such that the projectile is positioned adjacent to the carriage;

a driver attached to the carriage and extending along the bottom of the barrel toward an open end of the barrel;

a pair of first arms pivotally attached to and extending bilaterally from the barrel proximate to a butt end of the barrel, each first arm being operationally engaged to the driver distal from the carriage, wherein each first arm is configured for grasping in a respective hand of a user, positioning the user for pivoting the first arms relative to the barrel for charging the driver;

a catch attached to the barrel and being configured for selectively attaching to the driver upon charging of the driver;

a switch attached to the barrel and operationally engaged to the catch, wherein the switch is configured for switching for discharging the driver for propelling the projectile from the barrel; and wherein the driver comprises a cylinder attached, proximate to a first terminus of the cylinder, to the lower end of the carriage, the cylinder being slidably attached to the bottom of the barrel, a channel extending into the first terminus of the cylinder, a spring positioned in the channel, and a rod attached to the barrel, the rod being aligned with and selectively insertable into the channel, such that the spring is compressed by the rod as the cylinder is motivated along the barrel from the open end toward the butt end.

2. The projectile launching device of claim 1, wherein the barrel has a top, the top being open such that a cross-sectional profile of the barrel is U-shaped.

3. The projectile launching device of claim 1, further including a stock attached to the barrel, wherein the stock is configured for abutting a respective shoulder of the user.

4. The projectile launching device of claim 1, wherein the guide rail comprises a pair of guide rails bracketing the slot.

5. The projectile launching device of claim 1, further including a crossbar attached to and extending bilaterally from the barrel, each first arm being pivotally attached to the crossbar proximate to a respective opposed end of the crossbar.

6. The projectile launching device of claim 1, further including:

a bracket attached to and extending from the barrel, such that the rod extends between the bottom of the barrel and a lower piece of the bracket;

a handle attached to and extending from the lower piece of the bracket, wherein the handle is configured for grasping a respective hand of the user;

the catch comprising:

a first knob attached to an underside of the cylinder proximate to the first terminus, a recess extending into the lower piece of the bracket, a pin attached to the lower piece and positioned in the recess, the pin being spring loaded, a second knob attached to the pin, the second knob being tapered distal from the pin, such that the second knob is depressible into the recess upon contact with the first knob as the cylinder is motivated along the barrel from the open end toward the butt end, whereupon the second knob extends from the recess for locking the driver in a cocked configuration; and the switch comprising a trigger operationally engaged to the second knob, such that the second knob is retracted into the recess upon pulling of the trigger and such that the spring rebounds for propelling the projectile from the barrel.

7. The projectile launching device of claim 1, further including a pair of second arms, each second arm being pivotally attached to and extending between the cylinder, proximate to a second terminus of the cylinder, and a respective first arm.

8. The projectile launching device of claim 7, wherein the second arm is attached to the respective first arm proximate to a midpoint of the respective first arm.

9. The projectile launching device of claim 7, further including a bar attached to the cylinder proximate to a second terminus of the cylinder, the bar being flattened U-shaped, such that opposing ends of the bar bracket the cylinder, each second arm being pivotally attached to a respective opposing end of the bar.

10. The projectile launching device of claim 1, further including a notch positioned in a forward facet of the carriage, wherein the notch is configured for engaging a nock of an arrow or a bolt.

11. A projectile launching device comprising:

a barrel, the barrel having a top, the top being open such that a cross-sectional profile of the barrel is U-shaped;

a stock attached to the barrel, wherein the stock is configured for abutting a respective shoulder of a user;

a slot positioned in a bottom of the barrel;

a guide rail attached to the barrel and extending along the slot, the guide rail comprising a pair of guide rails bracketing the slot;

a carriage slidably engaged to the guide rail, a lower end of the carriage extending through the slot, wherein the barrel is configured for insertion of a projectile, such that the projectile is positioned adjacent to the carriage;

a driver attached to the carriage and extending along the bottom of the barrel toward an open end of the barrel, the driver comprising:

a cylinder attached, proximate to a first terminus of the cylinder, to the lower end of the carriage, the cylinder being slidably attached to the bottom of the barrel, a channel extending into the first terminus of the cylinder, a spring positioned in the channel, and a rod attached to the barrel, the rod being aligned with and selectively insertable into the channel, such that the spring is compressed by the rod as the cylinder is motivated along the barrel from the open end toward a butt end;

a bracket attached to and extending from the barrel, such that the rod extends between the bottom of the barrel and a lower piece of the bracket;

a handle attached to and extending from the lower piece of the bracket, wherein the handle is configured for grasping a respective hand of the user;

a pair of first arms pivotally attached to and extending bilaterally from the barrel proximate to the butt end of the barrel, each first arm being operationally engaged to the driver distal from the carriage, wherein each first arm is configured for grasping in a respective hand of the user, positioning the user for pivoting the first arms relative to the barrel for charging the driver;

a crossbar attached to and extending bilaterally from the barrel, each first arm being pivotally attached to the crossbar proximate to a respective opposed end of the crossbar;

a catch attached to the barrel and being configured for selectively attaching to the driver upon charging of the driver, the catch comprising:

a first knob attached to an underside of the cylinder proximate to the first terminus, a recess extending into the lower piece of the bracket, a pin attached to the lower piece and positioned in the recess, the pin being spring loaded, a second knob attached to the pin, the second knob being tapered distal from the pin, such that the second knob is depressible into the recess upon contact with the first knob as the cylinder is motivated along the barrel from the open end toward the butt end, whereupon the second knob extends from the recess for locking the driver in a cocked configuration;

a switch attached to the barrel and operationally engaged to the catch, wherein the switch is configured for switching for discharging the driver for propelling the projectile from the barrel, the switch comprising a trigger operationally engaged to the second knob, such that the second knob is retracted into the recess upon pulling of the trigger, and such that the spring rebounds for propelling the projectile from the barrel;

a pair of second arms, each second arm being pivotally attached to and extending between the cylinder, proximate to a second terminus of the cylinder, and a respective first arm, the second arm being attached to the respective first arm proximate to a midpoint of the respective first arm;

a bar attached to the cylinder proximate to the second terminus of the cylinder, the bar being flattened U-shaped, such that opposing ends of the bar bracket the cylinder, each second arm being pivotally attached to a respective opposing end of the bar; and a notch positioned in a forward facet of the carriage, wherein the notch is configured for engaging a nock of an arrow or a bolt.

* * * * *